US008556160B2

(12) United States Patent
Spivey, Sr.

(10) Patent No.: US 8,556,160 B2
(45) Date of Patent: Oct. 15, 2013

(54) CARTON WITH EXPANDABLE PANEL

(75) Inventor: Raymond R. Spivey, Sr., Mableton, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

(21) Appl. No.: 13/313,406

(22) Filed: Dec. 7, 2011

(65) Prior Publication Data

US 2012/0145774 A1 Jun. 14, 2012

Related U.S. Application Data

(60) Provisional application No. 61/459,294, filed on Dec. 10, 2010.

(51) Int. Cl.
*B65D 5/355* (2006.01)
*B65D 17/28* (2006.01)

(52) U.S. Cl.
USPC ..... 229/101; 206/427; 229/123; 229/242

(58) Field of Classification Search
USPC ..... 229/101, 117.13, 123, 131.1, 140, 164, 229/215, 240, 242, 243; 206/427; 221/302, 221/305, 306
See application file for complete search history.

(56) References Cited

U.S. PATENT DOCUMENTS 1,138,469 A * 5/1915 Goodkind ..... 229/131.1
2,077,341 A * 4/1937 Martin et al. ..... 229/215
3,185,374 A * 5/1965 Feeney ..... 229/215
3,886,901 A 6/1975 Zeitter
4,151,946 A * 5/1979 Schmidt et al. ..... 229/123
4,602,735 A * 7/1986 Aaron ..... 221/305
4,706,876 A * 11/1987 Wilson ..... 229/117.13
4,752,029 A * 6/1988 Buford ..... 229/123
4,974,771 A * 12/1990 Lavery ..... 229/117.13
5,094,359 A 3/1992 DeMars et al.
5,170,934 A * 12/1992 Lemoine ..... 229/101

(Continued)

FOREIGN PATENT DOCUMENTS

JP 2001-192016 7/2001
JP 2004-018010 1/2004

(Continued)

OTHER PUBLICATIONS

International Search Report and Written Opinion of the International Searching Authority for corresponding International Application No. PCT/US2011/063629 mailed Jul. 9, 2012.

*Primary Examiner* — Gary Elkins
(74) *Attorney, Agent, or Firm* — Womble Carlyle Sandridge & Rice, LLP

(57) ABSTRACT

A carton for containing a plurality of containers. The carton comprises a plurality of panels extending at least partially around an interior of the carton. The plurality of panels comprises a bottom panel, a first side panel foldably connected to the bottom panel, a top panel foldably connected to the first side panel, a second side panel foldably connected to the top panel, and an expansion panel foldably connected to the bottom panel. Opposite ends of the expansion panel are respectively foldably connected to expansion flaps, and the expansion flaps are at least partially in face-to-face contact with, and mounted to, the second side panel. A dispenser is positioned in at least the second side panel.

21 Claims, 8 Drawing Sheets

(56) References Cited

U.S. PATENT DOCUMENTS

| | | | | |
|---|---|---|---|---|
| 5,307,986 | A | 5/1994 | Schuster | |
| 5,582,343 | A | 12/1996 | Dalvey | |
| 5,706,947 | A * | 1/1998 | Hodges | 229/101 |
| 6,092,716 | A * | 7/2000 | Smith | 229/164 |
| 6,227,367 | B1 | 5/2001 | Harrelson et al. | |
| 6,945,450 | B2 | 9/2005 | Rusnock | |
| 7,416,109 | B2 | 8/2008 | Sutherland | |
| 7,699,215 | B2 | 4/2010 | Spivey, Sr. | |
| 7,717,318 | B2 | 5/2010 | Brand | |
| 7,762,394 | B2 | 7/2010 | Bradford et al. | |
| 2002/0000463 | A1 * | 1/2002 | Jaggi | 229/123 |
| 2003/0098344 | A1 * | 5/2003 | Blake | 221/305 |
| 2004/0112948 | A1 * | 6/2004 | Bone | 229/242 |
| 2006/0231604 | A1 | 10/2006 | DeBusk et al. | |
| 2007/0164091 | A1 | 7/2007 | Fogle et al. | |
| 2008/0290149 | A1 * | 11/2008 | Sweet | 229/140 |
| 2010/0140335 | A1 | 6/2010 | Brand | |
| 2011/0011924 | A1 | 1/2011 | Spivery, Sr. et al. | |

FOREIGN PATENT DOCUMENTS

| | | |
|---|---|---|
| JP | 2008-545596 | 12/2008 |
| KR | 20-1998-056170 | 10/1998 |
| WO | WO 2007/007197 | 1/2007 |

* cited by examiner

CARTON WITH EXPANDABLE PANEL

CROSS-REFERENCE TO RELATED APPLICATION

This application claims the benefit of U.S. Provisional Patent Application No. 61/459,294, which was filed on Dec. 10, 2010.

INCORPORATION BY REFERENCE

The entire disclosure of U.S. Provisional Patent Application No. 61/459,294, which was filed on Dec. 10, 2010, is incorporated herein by reference.

BACKGROUND

The present disclosure generally relates to cartons for holding beverage containers or other types of articles. More specifically, the present disclosure relates to cartons that are expandable.

SUMMARY

One aspect of this disclosure is generally directed to a carton for holding a plurality of containers. In one example, the carton comprises a plurality of panels extending at least partially around an interior of the carton. The plurality of panels can comprise a bottom panel, a first side panel foldably connected to the bottom panel, a top panel foldably connected to the first side panel, a second side panel foldably connected to the top panel, and an expansion panel foldably connected to the bottom panel. Opposite ends of the expansion panel may be respectively foldably connected to expansion flaps that are at least partially in face-to-face contact with, and mounted to, the second side panel. An access feature for providing access to the interior of the carton (e.g., a dispenser) may extend in at least the second side panel.

The bottom panel, first and second side panels and a top panel may together extend at least partially around an interior of the carton. The expansion panel comprises a cover panel that at least partially covers the second side panel and the access feature. The expansion flaps, optionally in conjunction with opposite marginal end portion of the expansion panel, may provide expandable connections between the cover panel the second side panel. The expandable connections may be spaced apart from one another, and the expandable connections may be expandable so that the cover panel is for being moved outwardly relative to the second side panel, from an inner configuration to an outer configuration, to at least partially define an upwardly open space for being open to the interior by way of the access feature of the second side panel. The expandable connections typically connect the cover panel to the second side panel in both of the inner and outer configurations.

Each of the expandable connections may include one or more pleats. In one specific example, each expandable connection includes an attachment flap connected to the second side panel, a first pleat panel connected to the attachment flap, and second pleat panel connected to the cover panel.

The foregoing presents a simplified summary of some aspects of this disclosure in order to provide a basic understanding. The foregoing summary is not extensive and is not intended to identify key or critical elements of the invention or to delineate the scope of the invention. The purpose of the foregoing summary is to present some concepts of this disclosure in a simplified form as a prelude to the more detailed description that is presented later. For example, other aspects will become apparent from the following.

BRIEF DESCRIPTION OF THE DRAWINGS

Having described some aspects of this disclosure in general terms, reference will now be made to the accompanying drawings, which are not necessarily drawn to scale. The drawings are exemplary only, and should not be construed as limiting the invention.

DETAILED DESCRIPTION

Exemplary embodiments of this disclosure are described below and shown in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention.

The present disclosure generally relates to opening, dispensing, and handling features for cartons that contain articles such as containers, bottles, cans, etc. The articles can be used for packaging food and beverage products, for example. The articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., aluminum beverage cans) as disposed within the carton embodiments. In this specification, the terms "lower," "bottom," "upper" and "top" indicate orientations determined in relation to fully erected and upright cartons.

Figure 1:
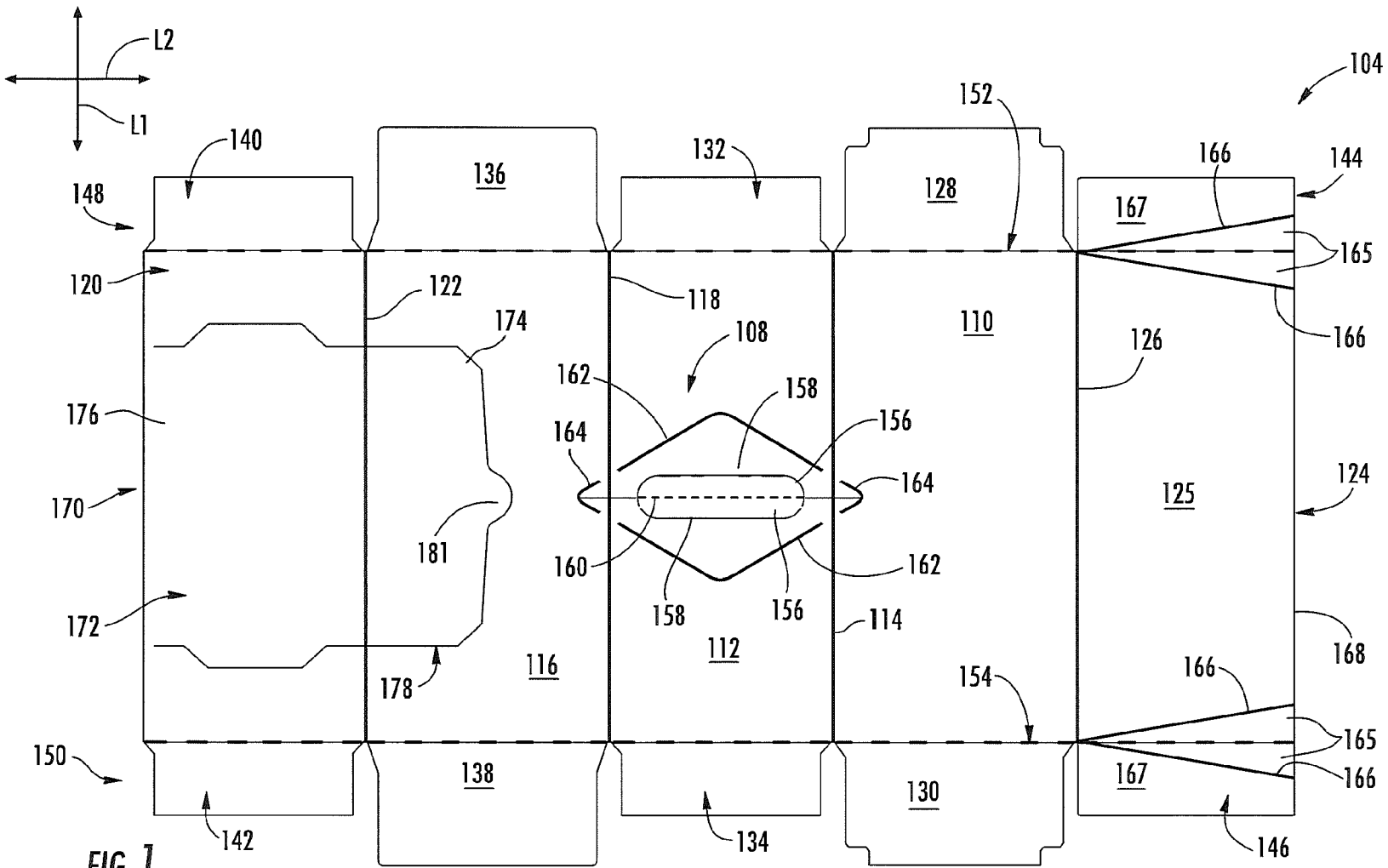
FIG. 1 is a plan view of a blank according to an exemplary embodiment of this disclosure.

Referring now in greater detail to the drawings, FIG. 1 is a plan view of a blank, generally indicated at 104, used to form a carton 106 (FIGS. 4-8) according to an exemplary embodiment of this disclosure. The carton 106 can be used to house a plurality of articles such as containers C (shown by way of example in FIGS. 4-7). In the embodiment shown in the drawings, the containers C are generally-cylindrical cans, and the carton 106 is sized to house eight containers C in a single layer in a 2×4 arrangement. However, the carton 106 may be sized and shaped to hold containers C of a different or same quantity in more than one layer and/or in different row/column arrangements (e.g., 1×6, 3×6, 2×6, 2×6×2, 3×4×2, 2×9, 4×3, etc.). The containers C could be otherwise shaped, arranged, and/or configured without departing from the disclosure. For example, the containers C could be beverage bottles or other containers. In the embodiment shown in the drawings, the carton 106 includes a handle, generally indicated at 108, for grasping and carrying the carton.

The blank 104 has a longitudinal axis L1 and a lateral axis L2. In the embodiment shown in the drawings, the blank 104 comprises a bottom panel 110 foldably connected to a first side panel 112 at a first lateral fold line 114, a top panel 116 foldably connected to the first side panel 112 at a second lateral fold line 118, and a second side panel 120 foldably connected to the top panel 116 at a third lateral fold line 122. An expansion panel 124 is foldably connected to the bottom panel 110 at a fourth lateral fold line 126.

The bottom panel 110 is foldably connected to a first bottom end flap 128 and a second bottom end flap 130. The first side panel 112 is foldably connected to a first side end flap 132 and a second side end flap 134. The top panel 116 is foldably connected to a first top end flap 136 and a second top end flap 138. The second side panel 120 is foldably connected to a first side end flap 140 and a second side end flap 142. The expansion panel 124 is foldably connected to a first expansion end flap 144 and a second expansion end flap 146. As best understood with reference to FIGS. 3 and 4, when the carton 106 is erected, the end flaps 128, 132, 136, 140 close a first end 148 of the carton, and the end flaps 130, 134, 138, 142 close a second end 150 of the carton. More specifically and as best understood with reference to FIGS. 6-8, the expansion end flaps 144, 146 partially form end walls 188 that close ends of an upwardly open expansion space 192, as will be discussed in greater detail below. In accordance with an alternative embodiment of the present disclosure, different flap arrangements can be used for closing the ends of the carton 106.

Referring to FIG. 1, the end flaps 128, 132, 136, 140, 144 extend along a first marginal area of the blank 104, and are foldably connected at a first longitudinal fold line 152 that extends along the length of the blank. The end flaps 130, 134, 138, 142, 146 extend along a second marginal area of the blank 104, and are foldably connected at a second longitudinal fold line 154 that also extends along the length of the blank. The longitudinal fold lines 152, 154 may be, for example, substantially straight, or offset at one or more locations to account for blank thickness or for other factors.

As shown in FIG. 1 and in accordance with the exemplary embodiment, the expansion end flaps 144, 146 and adjacent portions of the expansion panel 124 include oblique score lines 166. Pairs of the oblique score lines extend divergently from (e.g., from proximate) the intersections of the respective longitudinal fold lines 152, 154 and the fourth lateral fold line 126 to an outermost end edge 168 of the blank 104. In the embodiment shown in the drawings, a pleat panel 165 is defined between each score line 166 and the respectively adjacent longitudinal fold line 152, 154. More specifically, the oblique score lines 166 in the expansion panel 124 may be characterized as dividing the expansion panel into a cover panel 125 positioned between an inner pair of the pleat panels 165. Similarly, for each of the expansion end flaps 144, 146, the oblique score line 166 in the expansion end flap may be characterized as dividing the expansion panel into a pleat panel 165 and an attachment flap 167 that is for being mounted to the second side panel 120. Each attachment flap 167 may alternatively be referred to as another pleat panel, wherein this other pleat panel may be mounted to the second side panel 120.

In the embodiment shown in the drawings, each of the pleat panels 165 extends to the outermost end edge 168 of the blank 104. Also, each of the pleat panels 165 is triangular, such that the pleat panels may be referred to triangular panels. As another example, the oblique score lines 166 respectively define the hypotenuses of the triangular pleat panels 165.

As shown in FIG. 1, the blank includes handle features for forming the handle 108 of the carton 106. The handle features include two handle flaps 156 foldably connected to the first side panel 112 at respective longitudinal fold lines 158 and separable along tear line 160, which extends into the top panel 116 and the bottom panel 110. Two generally V-shaped scores 162 extend in the first side panel 112 on either side of the handle flaps 156, and two generally V-shaped scores 164 extend in the respective top panel 116 and bottom panel 110 at respective ends of the tear line 160. The V-shaped scores 162, 164 allow the top panel, the first side panel, and the bottom panel to flex proximate the handle 108 when the carton 106 is grasped and carried by the handle 108. The handle 108 could be otherwise shaped, arranged, positioned, configured, or omitted without departing from the disclosure.

In the embodiment shown in the drawings, an access feature 170 (e.g., dispenser) can extend in the top panel 116 and the second side panel 120. The access feature 170 can include a dispenser panel 172 with a top portion 174 and a side portion 176. Each of the dispenser panel's portions 174, 176 may be referred to as a dispenser panel. The dispenser panel 172 is separable from the top panel 116 and at least partially separable from the second side panel 120 along a tear line 178 to form a dispenser opening 180 (FIGS. 5-8) in the carton 106. The access feature 170 can include an access tab or finger panel 181 in the top panel 116. Alternatively, the access tab 181 could be replaced by an access flap foldably connected to the top panel 116 or an access aperture for facilitating the initiation of the tearing of the access feature along the tear line 178. Further, the tear line 178 can be, for example, a single tear line, multiple segmented tear lines, or a series of cut lines. The access feature 170 can be otherwise shaped, arranged, positioned, configured, or omitted without departing from the disclosure.

Figure 2:
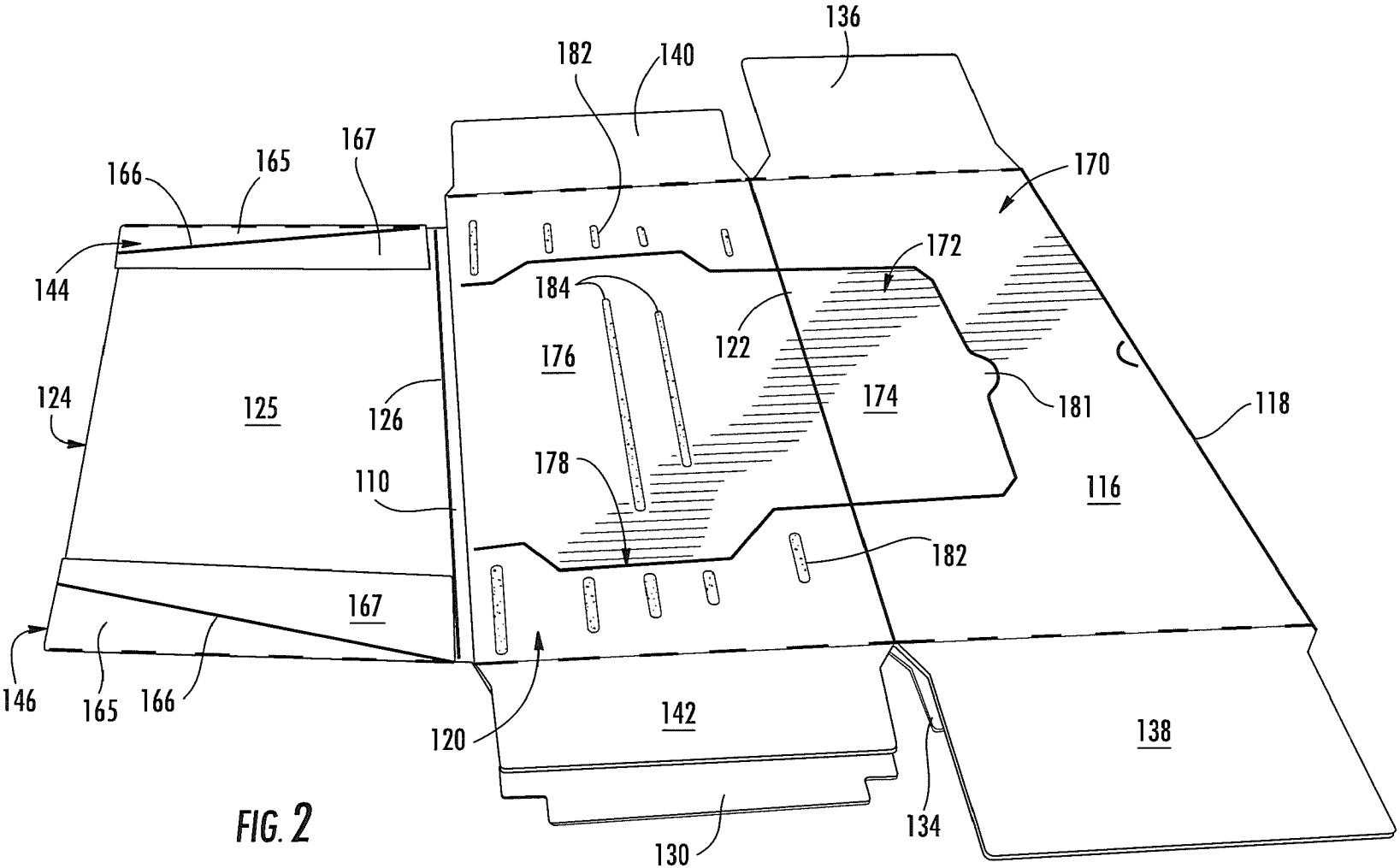
FIG. 2 shows the blank of FIG. 1 in a partially erected configuration, in accordance with the exemplary embodiment.
Figure 3:
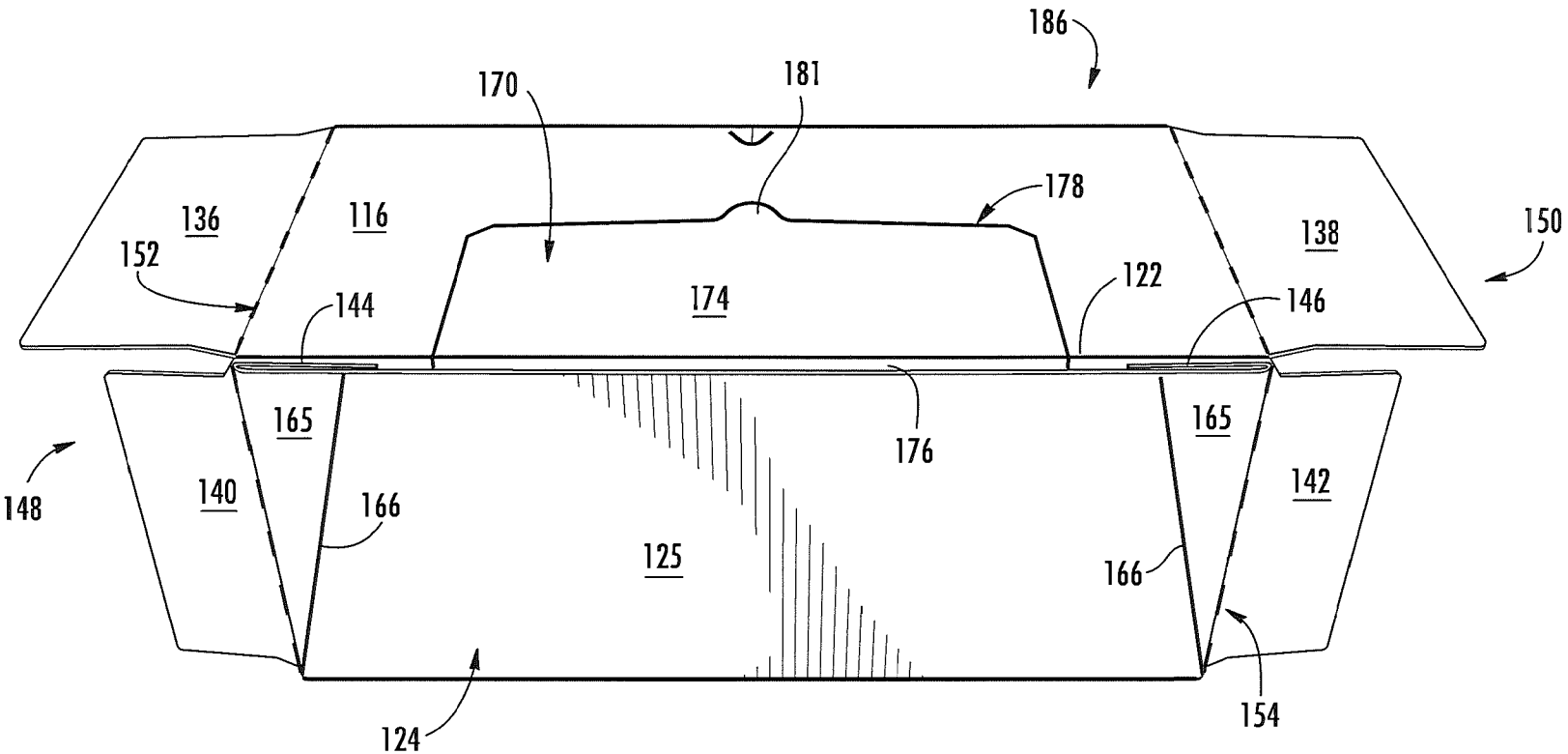
FIG. 3 is a perspective view of an open-ended sleeve formed from the blank of FIG. 1, in accordance with the exemplary embodiment.

A step in erecting the blank 104 in accordance with the exemplary embodiment is shown in FIG. 2. The expansion end flaps 144, 146 are folded along the respective longitudinal fold lines 152, 154 so that the expansion end flaps are in face-to-face contact with the inner surface of the expansion panel 124 and each of the pleat panels 165 is generally in opposing face-to-face contact with a respective adjacent pleat panel. As also shown in FIG. 2, the second side panel 120 and the top panel 116 can be folded along the second lateral fold line 118 to generally overlap the bottom panel 110 and the first side panel 112, respectively. Then, the expansion panel 124 can be folded along the fourth lateral fold line 126 so that the expansion end flaps 144, 146 are in face-to-face contact with an exterior surface of the second side panel 120. The attachment flaps 167 are glued to the second side panel 120 with adhesive 182 applied to the attachment flaps, the second side panel 120, or both. The pleat panels 165 are typically not glued to the second side panel 120, or glued to the second side panel with releasable adhesive material, so that the pleat panels 165 can easily separate from the second side panel when the cover panel 125 is pivoted away from the second side panel. At least a portion of the interior surface of the cover panel 125 is typically connected/adhered to the side portion 176 of the dispenser panel 172 with glue 184 applied to one or both of the dispenser panel and the expansion panel. Thereafter, the blank can be folded along fold lines 114, 118, 122, 126, to form a partially-erected carton in the form of an open-ended sleeve 186 (FIG. 3). The open-ended sleeve 186 can be otherwise formed or arranged without departing from the disclosure.

Some aspects of erecting the carton 106 are further described in the following, in accordance with the exemplary embodiment of this disclosure. There may be relative folding between the series of panels 110, 112, 116, 120, 124 so that the second side panel 120 is positioned between the first side panel 110 and the expansion panel 124. The cover panel 125 may be connected to the second side panel 120 with the series of panels/expandable connections defined by the attachment flaps 167 and pleats/pleat panels 165, after the relative folding between the pleat panels 165.

Figure 8:
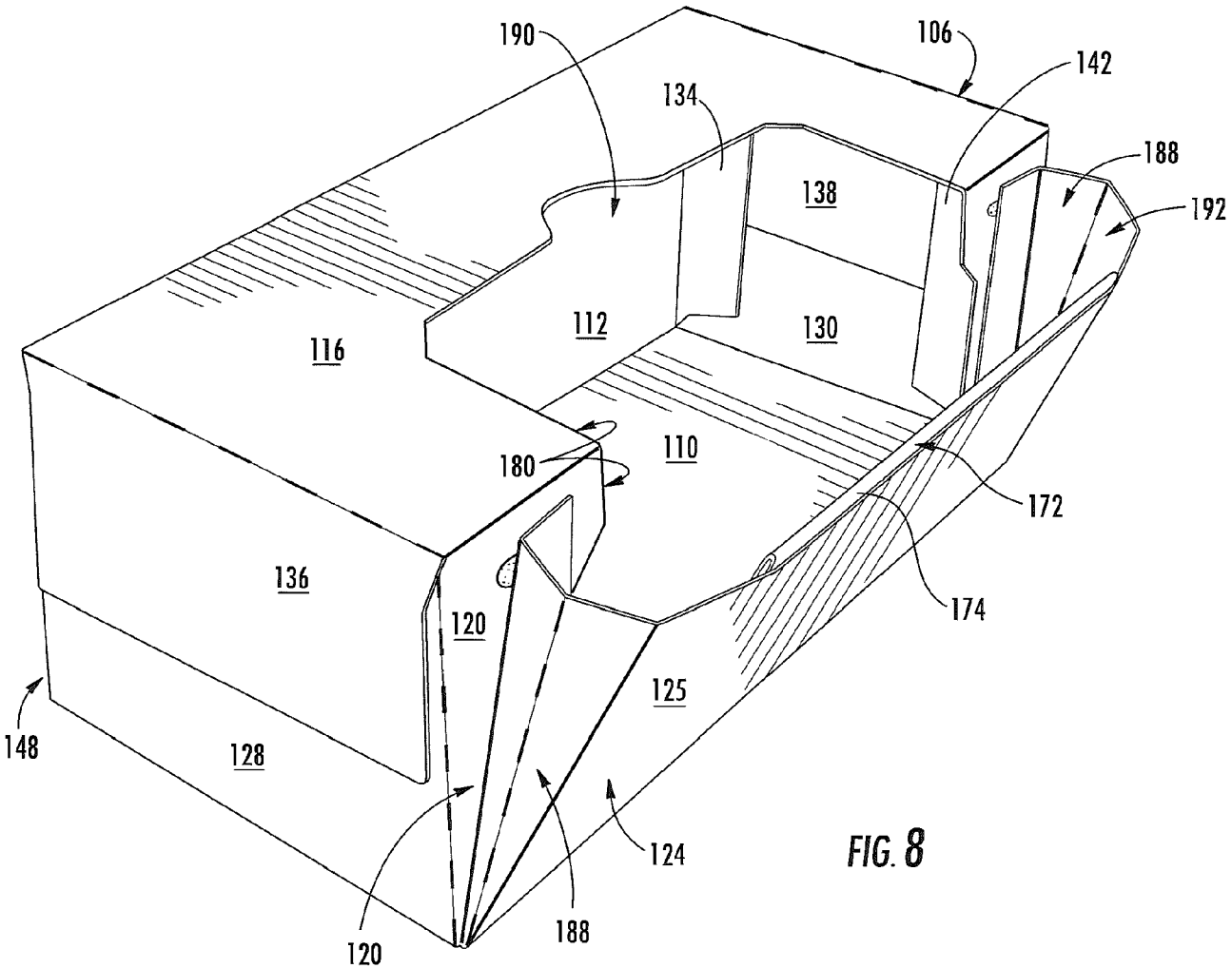

In the assembled, closed carton 106, each of the attachment flaps 167 is mounted to the second side panel 120, and each of the pleat panels 165 is generally in face-to-face contact with an adjacent pleat panel (FIG. 4) to respectively form pleats. When the cover panel 125 is pivoted away from the second side panel 120, the pleats are enlarged, comprising the pleat panels 165 respectively pivoting away from one another by way of folding along the respective score lines 166 and longitudinal fold lines 152, 154 (FIG. 8). Alternatively, the expansion panel, expansion end flaps, pleats and pleat panels can be otherwise shaped, configured, arranged, position, or omitted without departing from the disclosure.

Figure 4:
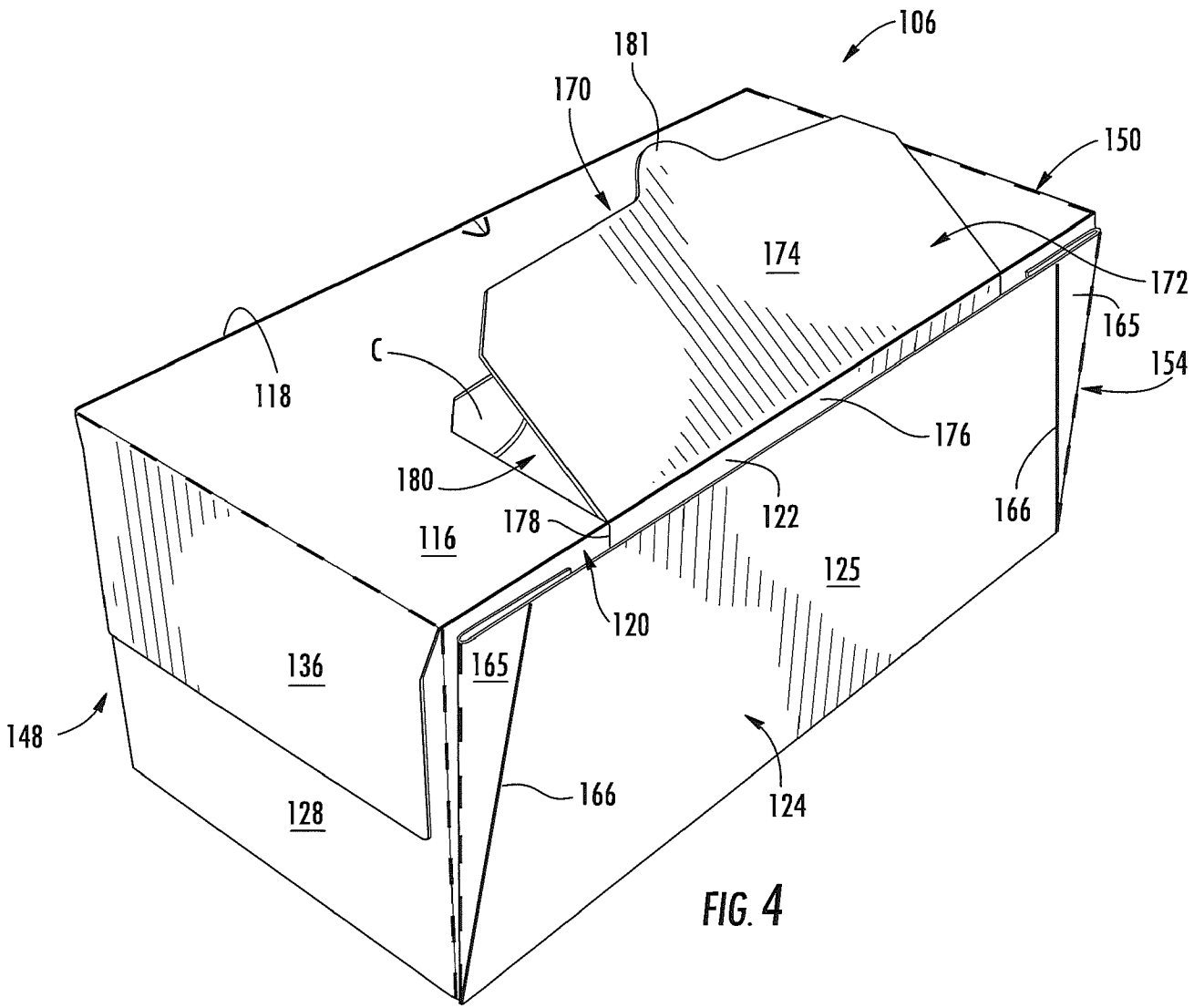
FIGS. 4 and 5 are perspective views of a carton formed from the blank of FIG. 1 being opened and expanded, respectively, wherein a cover panel portion of an expansion panel is in inner and intermediate configurations in FIGS. 4 and 5, respectively, in accordance with the exemplary embodiment.
Figure 5:
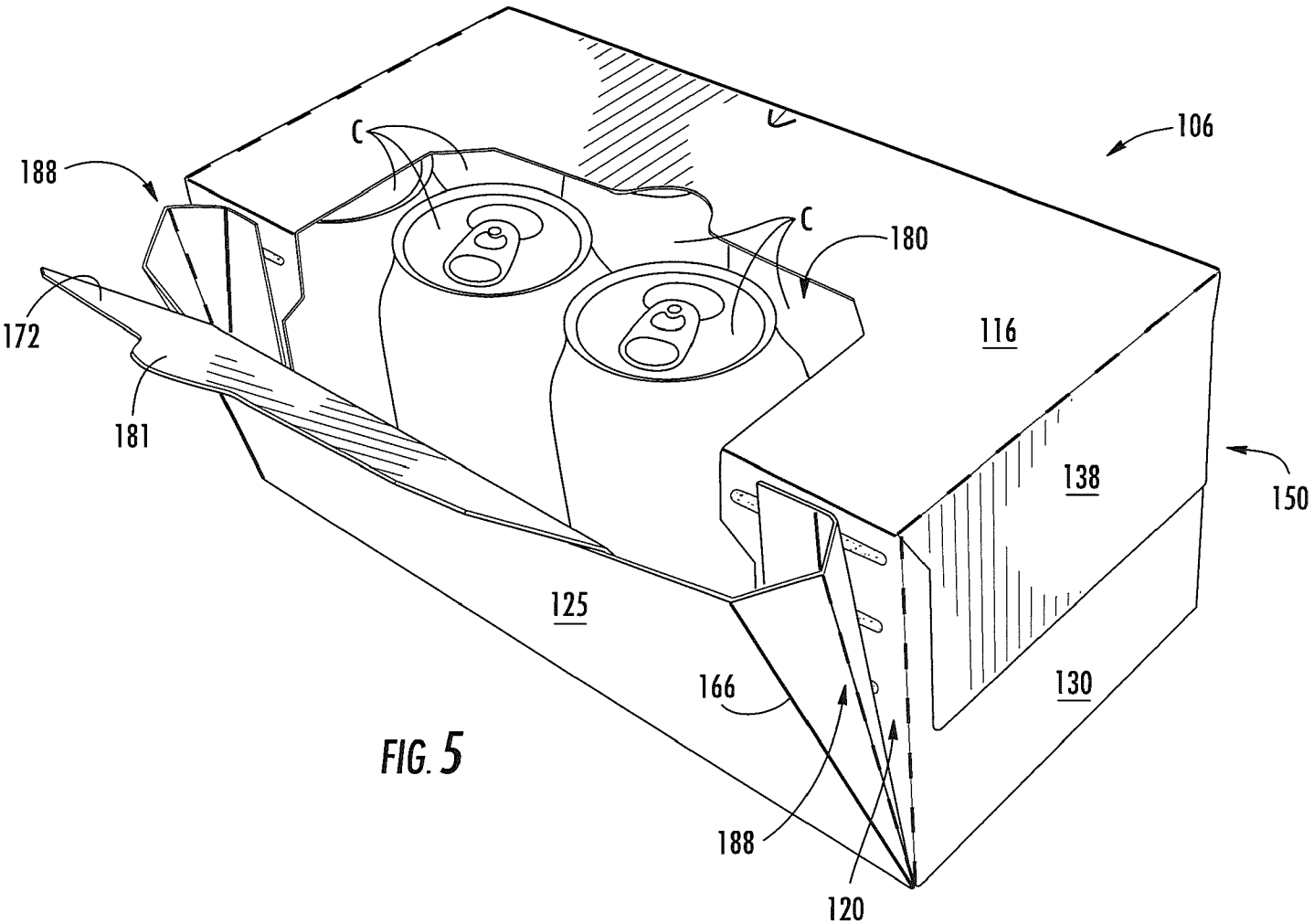

In the embodiment shown in the drawings, the first end 148 of the carton 106 is closed by respectively overlapping and adhering the end flaps 128, 132, 136, 140, such as after loading the containers C into the sleeve 186. The closed first end 148 is shown in FIGS. 4 and 8. Similarly, the second end 150 of the carton 106 is closed by respectively overlapping the end flaps 130, 134, 138, 142. The closed second end 150 is shown in FIG. 5. Other closing and loading sequences can be used without departing from the disclosure. For example, the containers can be loaded into the carton 106 after closing the first end 148 or the second end 150.

As shown in FIGS. 4-7, the carton 106 can be shaped to hold containers such as cans C in an upright position. The side panels 112, 120 and the ends 148, 150 of the carton 106 extend generally vertically between the top panel 116 and the bottom panel 110. Alternatively, the carton 106 of the present disclosure could be a one-, two-, three-, or four-sided taper carton where the bottom panel 110 is both longer and wider in the directions L1, L2 than the top panel 116. A three-sided taper carton, for example, can have ends 148, 150 angling inwardly and at least an upper portion of the first side panel 112 could be angled inwardly. In another alternative, the corners of the carton 106 between the first side panel 112 and each end 148, 150, and between the second side panel 120, and each end 148, 150 can be angled to generally follow the contour of the containers C at the corners of the carton.

Some aspects of the erected carton 106 are further described in the following, in accordance with the exemplary embodiment of this disclosure. In accordance with one aspect of this disclosure, the bottom panel 110, first side panel 112, a top panel 116 and second side panel 120 form an enclosure extending at least partially around a main interior 190 (FIG. 8) of the carton 106. More specifically, the bottom panel 110 has opposite first and second edges, the first side panel 112 extends upwardly from proximate the first edge of the bottom panel, the top panel 116 has opposite first and second edges, the first side panel 112 extends downwardly from proximate the first edge of the top panel, and the second side panel 120 extends downwardly from proximate the second edge of the top panel, so that the carton's main interior 190 is positioned between the top and bottom panels, and the carton's interior is positioned between the first and second side panels. More specifically, the second side panel 120 extends downwardly from proximate the second edge of the top panel 116 substantially toward the second edge of the bottom panel 110. The cover panel 125 extends upwardly from proximate the second edge of the bottom panel 110, so that the second side panel 120 is positioned between the carton's interior and the cover panel, and the cover panel covers at least a portion of each of the second side panel and the dispenser panel 176 in the second side panel. More specifically, the cover panel 125 extends upwardly from proximate the second edge of the bottom panel 110 substantially toward the second edge of the top panel 116.

Figure 6:
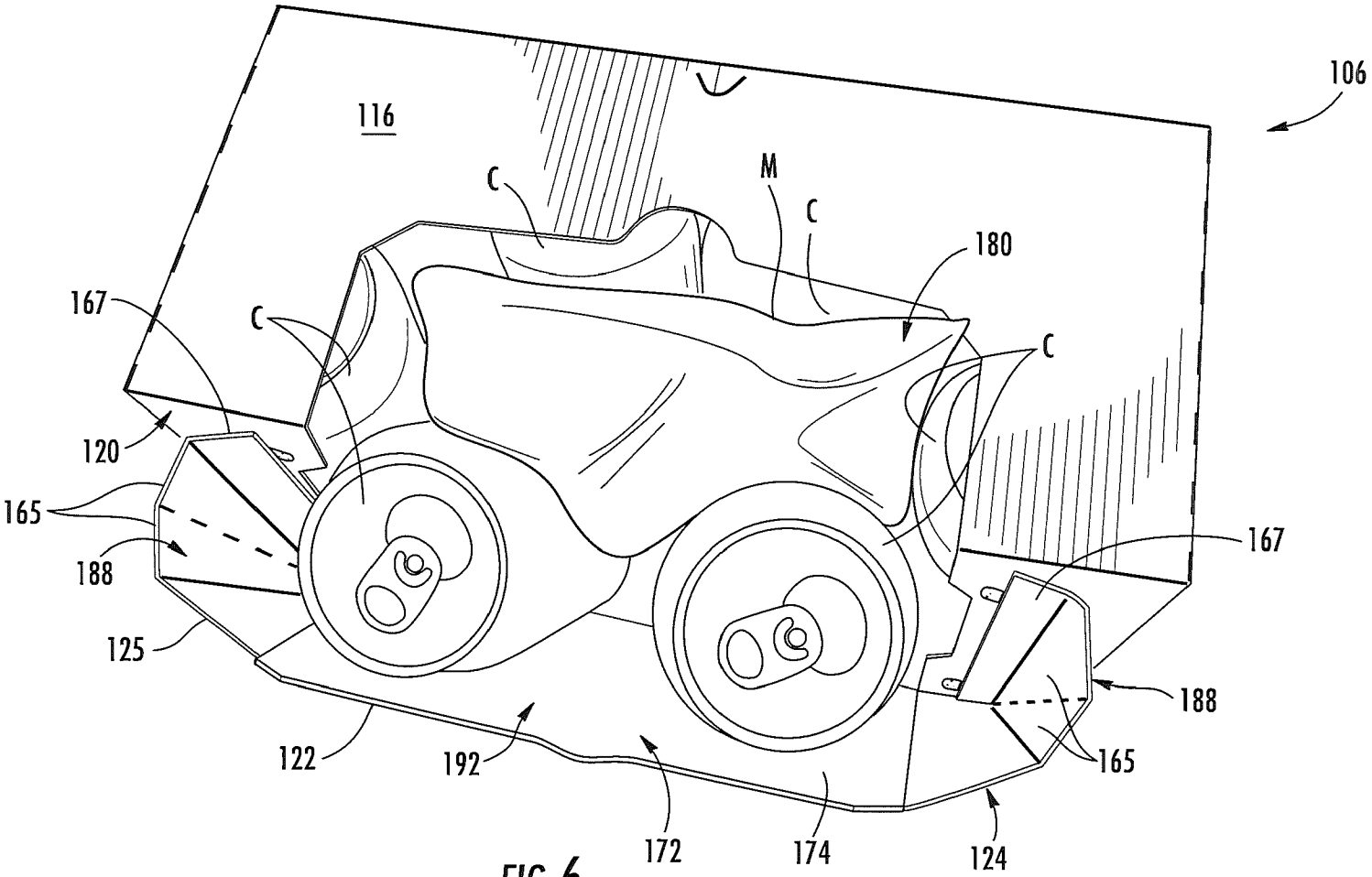
FIGS. 6-8 are perspective views of the carton of FIG. 5 with an opened dispenser and the cover panel in an outer configuration, in accordance with the exemplary embodiment.
Figure 7:
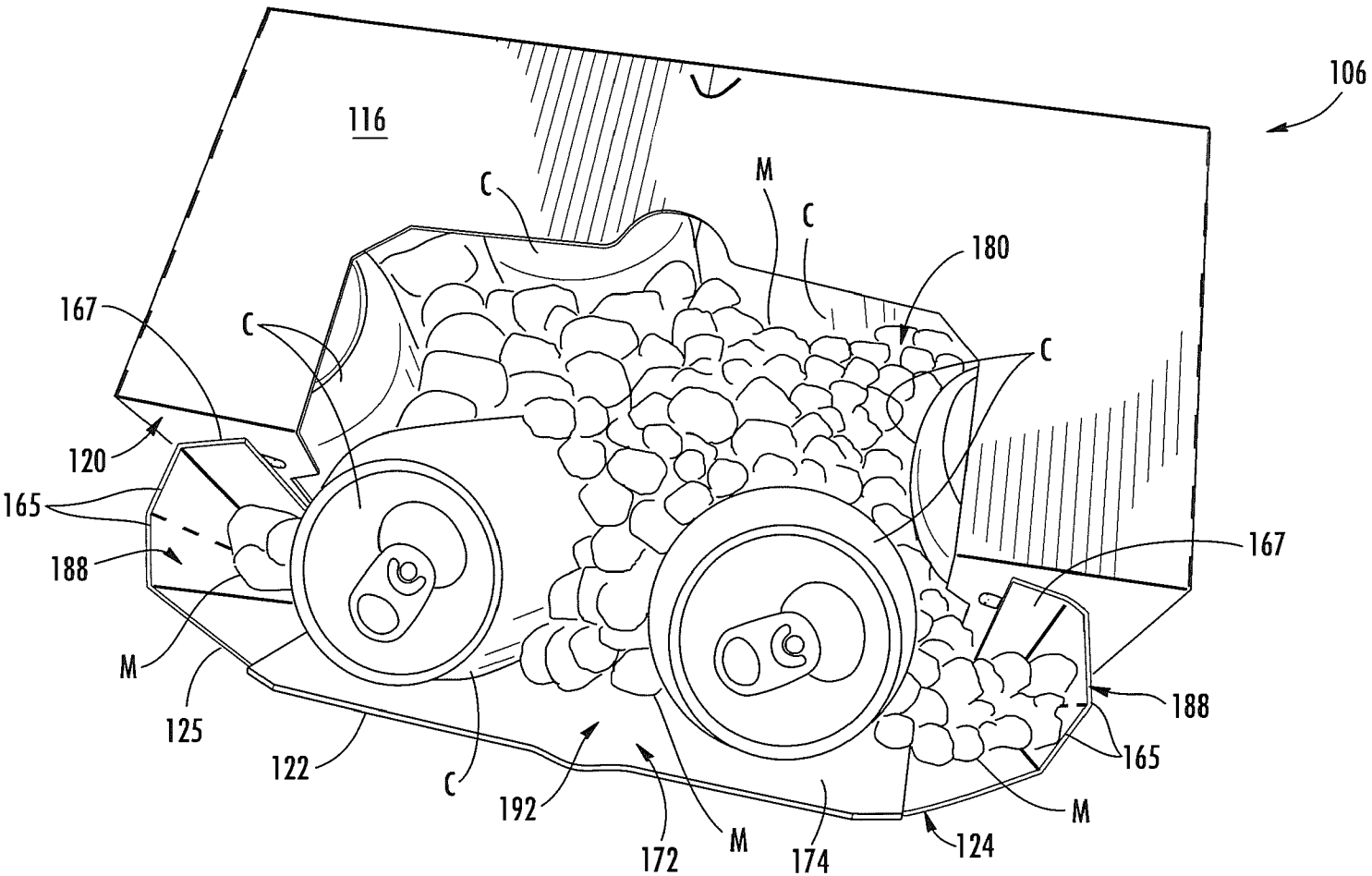

Referring to FIG. 4, the dispenser 170 can be opened to access the containers C in the carton 106 by pushing inwardly on the access tab 181 to initiate tearing of the tear line 178 and pulling the top portion 174 of the dispenser panel 172 away from the top panel 116, separating the top portion 174 from the top panel along the tear line 178. The top portion 174 is folded upwardly about the third lateral fold line 122. A user can remove containers C from the dispenser opening 180 formed by opening the top portion 174 of the dispenser panel 172. Referring to FIG. 5, a user can continue to tear the tear line 178 extending in the second side panel 120 to at least partially separate the side portion 176 of the dispenser panel 172 from the second side panel. Pulling the side portion 176 outwardly also pivots the cover panel 125 about the fourth lateral fold line 126 to expand the dispenser opening 180 (FIGS. 5 and 8) and allow one or more of the containers C to pivot away from the center of the carton 106 (FIGS. 6 and 7). As shown in FIGS. 6-8, the top portion 174 of the dispenser panel 172 can be folded along the third lateral fold line 122 into face-to-face contact with the side portion 176 of the dispenser panel. The displacement of the one or more containers C at the expanded dispenser opening 180 can provide space in the interior of the carton 106 for a cooling medium M, such as a gel-filled ice pack (FIG. 6), ice cubes (FIG. 7), or other materials. In the embodiment shown in the drawings, the cooling medium M is positioned between rows of the containers C for quickly cooling the containers.

As shown in FIG. 8, as the expansion panel 124 pivots outwardly, the expansion panel and the expansion end flaps 144, 146 fold along the oblique score lines 166 so that the pleat panels 165 of each pair of adjacent pleat panels 165 pivot away from one another to form generally V-shaped end walls 188. The end walls 188 can help retain the containers C and the cooling medium M within the carton 106. According to one embodiment, one or more gusset panels can be included at one or more of the corners of the bottom panel 110 for further retaining the cooling medium M in the interior of the carton 106.

Some aspects of the carton 106 and a method of using the carton are further described in the following, in accordance with the exemplary embodiment of this disclosure. In one aspect of this disclosure, the attachment flaps 167 and pleats/pleat panels 165 define expandable connections, and these expandable connections are between the cover panel 125 and the enclosure defined by the bottom, side and top panels 110, 112, 116, 120. The expandable connections, which are defined by the attachment flaps 167 and pleats 165, are spaced apart from one another and expandable so that the cover panel 125 is for being moved outwardly relative to the enclosure, which is defined by the bottom, side and top panels 110, 112, 116, 120, from an inner configuration (FIG. 4) to an outer configuration (FIGS. 6-8), to at least partially define an upwardly open expansion space 192 (FIG. 8) that is open to the main interior space 190. The expandable connections, which are defined by the attachment flaps 167 and pleats 165, connect the cover panel 125 to the enclosure, which is defined by the bottom, side and top panels 110, 112, 116, 120, in both of the inner and outer configurations. The end walls 188 defined by the pleats 165 close the opposite ends of the upwardly open expansion space 192 in the outer configuration.

In accordance with one aspect of this disclosure, the access feature/dispenser 170 may be opened to at least enlarge the opening 180 to the main interior 190 of the carton 106. This may involve at least partially separating the side dispenser panel 176 from a portion of the carton 106. This may involve urging the side dispenser panel outwardly relative to the portion of the carton 106, including tearing along the tear line 178. The side dispenser panel 176 carries the cover panel 125 along with the dispenser panel, so that the cover panel moves outwardly relative to the portion of the carton 106, in response to the dispenser panel moving outwardly relative to the portion of the carton. As a result, the expandable connections, which are defined by the attachment flaps 167 and pleats 165, are expanded, and the integrity of the expandable connections is maintained, so that the end walls 188, which are defined by the pleats 165, close the opposite ends of the upwardly open expansion space 192. More generally, in some situations some tearing between the pleats 165 may occur, but typically any such tearing will be kept to a minimum so that the integrity of the expandable connections is at least partially maintained.

In general, the blank 104 may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blank may then be coated with a varnish to protect information printed on the blanks. The blank may also be coated with, for example, a moisture barrier layer, on either or both sides of the blanks. The blank can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all types of adhesive materials commonly used to secure carton panels in place.

The above examples are in no way intended to limit the scope of the present invention. It will be understood by those skilled in the art that while the present disclosure has been discussed above with reference to exemplary embodiments, various additions, modifications and changes can be made thereto without departing from the spirit and scope of the invention as set forth in the claims.

What is claimed is:

1. A carton, comprising:

an enclosure extending at least partially around an interior of the carton, the enclosure comprising a bottom panel having opposite first and second edges, a first side panel extending upwardly from proximate the first edge of the bottom panel, a top panel having opposite first and second edges, the first side panel extending downwardly from proximate the first edge of the top panel, and a second side panel extending downwardly from proximate the second edge of the top panel, so that the interior is positioned between the top and bottom panels, and the interior is positioned between the first and second side panels, wherein the second side panel comprises an access feature for providing access to the interior;

a cover panel extending upwardly from proximate the second edge of the bottom panel, so that the second side panel is positioned between the interior and the cover panel, and the cover panel covers at least a portion of each of the second side panel and the access feature, wherein the cover panel has opposite first and second end edges, the first and second end edges of the cover panel extend upwardly from proximate the second edge of the bottom panel, and the first and second end edges of the cover panel extend divergently with respect to one another in an upward direction;

expandable connections between the cover panel and the enclosure, the expandable connections being spaced apart from one another, and the expandable connections being expandable so that the cover panel is for being moved outwardly relative to the enclosure, from an inner configuration to an outer configuration, to at least partially define an upwardly open space for being open to the interior by way of the access feature of the second side panel, and the expandable connections connect the cover panel to the enclosure in both of the inner and outer configurations; and an expandable connection of the expandable connections comprises a first triangular pleat panel having an edge foldably connected to the first end edge of the cover panel at an oblique fold line, and a second triangular pleat panel connected to the first triangular pleat panel.

2. The carton according to claim 1, wherein:

the expandable connection is a first expandable connection, and a second expendable connection of the expandable connections comprises a pleat.

3. The carton according to claim 1, wherein the expandable connections close opposite ends of the upwardly open space in the outer configuration.

4. The carton according to claim 1, wherein:

the expandable connection of the expandable connections comprises an attachment flap connected to the second side panel; and the second triangular pleat panel is connected to the attachment flap.

5. The carton according to claim 1, wherein the second side panel extends downwardly from the second edge of the top panel substantially toward the second edge of the bottom panel.

6. The carton according to claim 1, wherein the cover panel extends upwardly from the second edge of the bottom panel substantially toward the second edge of the top panel.

7. The carton according to claim 1, wherein the access feature comprises a opening in the second side panel.

8. The carton according to claim 1, wherein the access feature comprises a dispenser at least partially defined by tear lines.

9. The carton according to claim 8, wherein the dispenser extends into the top panel.

10. A carton comprising:

an enclosure extending at least partially around an interior of the carton, the enclosure comprising a bottom panel having opposite first and second edges, a first side panel extending upwardly from proximate the first edge of the bottom panel, a top panel having opposite first and second edges, the first side panel extending downwardly from proximate the first edge of the top panel, and a second side panel extending downwardly from proximate the second edge of the top panel, so that the interior is positioned between the top and bottom panels, and the interior is positioned between the first and second side panels, wherein the second side panel comprises an access feature for providing access to the interior, and the access feature comprises a dispenser panel for being torn at least partially away from the second side panel to at least enlarge an opening in the second side panel;

a cover panel extending upwardly from proximate the second edge of the bottom panel, so that the second side panel is positioned between the interior and the cover panel, and the cover panel covers at least a portion of each of the second side panel and the access feature;

expandable connections between the cover panel and the enclosure, the expandable connections being spaced apart from one another, and the expandable connections being expandable so that the cover panel is for being moved outwardly relative to the enclosure, from an inner configuration to an outer configuration, to at least partially define an upwardly open space for being open to the interior by way of the access feature of the second side panel, and the expandable connections connect the cover panel to the enclosure in both of the inner and outer configurations; and the dispenser panel being connected to the cover panel for moving outwardly with the cover panel.

11. The carton according to claim 10, wherein:

the dispenser panel is a first dispenser panel;

the dispenser further comprises a second dispenser panel for being torn away from the top panel, and the second dispenser panel is connected to the first dispenser panel.

12. The carton according to claim 11, wherein the second dispenser panel is foldably connected to the first dispenser panel, so that both:

the first dispenser panel is for being torn at least partially away from the second side panel, to at least enlarge an opening in the second side panel, in response to the second dispenser panel being torn away from the top panel, and the cover panel is for moving outwardly with the first dispenser panel to at least partially define the upwardly open space in response to the second dispenser panel being torn away from the top panel.

13. A blank for being erected into a carton, the blank comprising:

a plurality of panels extending a longitudinal direction between opposite first and second outermost end edges of the blank, first and second panels of the plurality of panels being foldably connected to one another at a lateral fold line extending in a lateral direction that is crosswise to the longitudinal direction, the first panel extending to the first outermost end edge of the blank, the first panel having opposite first and second end edges spaced apart from one another in the lateral direction, and each of the first and second end edges of the first panel extending obliquely to both the longitudinal direction and the lateral direction;

a first triangular panel foldably connected to the first end edge of the first panel at a first oblique fold line, and the first triangular panel extending to the first outermost end edge of the blank;

a second triangular panel foldably connected to the second end edge of the first panel at a second oblique fold line, the second triangular panel extending to the first outermost end edge of the blank; and a third triangular panel foldably connected to the first triangular panel at a first longitudinal fold line, and the third triangular panel extending to the first outermost end edge of the blank.

14. The blank according to claim 13, wherein the lateral fold line is a first lateral fold line, and the plurality of panels comprises:

a third panel foldably connected to the second panel of the plurality of panels at a second lateral fold line, the third panel comprising a handle;

a fourth panel foldably connected to the third panel of the plurality of panels at a third lateral fold line, the fourth panel comprising a dispenser panel; and a fifth panel foldably connected to the fourth panel of the plurality of panels at a fourth lateral fold line, the fifth panel comprising a dispenser panel, and the dispenser panel of the fifth panel being foldably connected to the dispenser panel of the fourth panel at the fourth lateral fold line.

15. The blank according to claim 13, wherein:

the first triangular panel has a hypotenuse, and the hypotenuse of the first triangular panel is foldably connected to the first end of the first panel at the first oblique fold line; and the second triangular panel has a hypotenuse, and the hypotenuse of the second triangular panel is foldably connected to the second end of the first panel at the second oblique fold line.

16. The blank according to claim 13, further comprising a fourth triangular panel foldably connected to the second triangular panel at a second longitudinal fold line, and the fourth triangular panel extending to the first outermost end edge of the blank.

17. The blank according to claim 16, further comprising:

a first flap extending to the first outermost end edge of the blank, the first flap being foldably connected to an hypotenuse of the third triangular panel at a third oblique fold line, and the third and first oblique fold lines extending divergently with respect to one another in a direction away from the second panel of the plurality of panels; and a second flap extending to the first outermost end edge of the blank, the second flap being foldably connected to an hypotenuse of the fourth triangular panel at a fourth oblique fold line, and the fourth and second oblique fold lines extending divergently with respect to one another in a direction away from the second panel of the plurality of panels.

18. A carton, comprising:

an enclosure extending at least partially around an interior of the carton, the enclosure comprising a bottom panel foldably connected to a first side panel at a first lateral fold line, a top panel foldably connected to the first side panel at a second lateral fold line, and a second side panel foldably connected to the top panel at a third lateral fold line, wherein the interior is positioned between the top and bottom panels, the interior is positioned between the first and second side panels, and the second side panel comprises an access feature for providing access to the interior;

a cover panel foldable connected to the bottom panel at a fourth lateral fold line, the second side panel being positioned between the interior and the cover panel, and the cover panel covering at least a portion of each of the second side panel and the access feature, wherein each of the first, second, third and fourth lateral fold lines extend in a lateral direction, and the cover panel has opposite first and second end edges that each extend obliquely to the lateral direction; and first and second expandable connections between the cover panel and the enclosure, wherein the first and second expandable connections are spaced apart from one another and expandable so that the cover panel is for being moved outwardly relative to the enclosure, from an inner configuration to an outer configuration, to at least partially define an upwardly open space for being open to the interior by way of the access feature of the second side panel, and the expandable connections connect the cover panel to the enclosure in both of the inner and outer configurations, each of the first and second expandable connections comprises a first triangular pleat panel foldably connected to a second triangular pleat panel at a longitudinal fold line, the longitudinal fold lines extend in a longitudinal direction that is crosswise to the lateral direction, the first and second end edges of the cover panel each extend obliquely to the longitudinal direction, an edge of the first triangular pleat panel of the first expandable connection is connected to the first end edge of the cover panel at a first oblique fold line, and an edge of the first triangular pleat panel of the second expandable connection is connected to the second end edge of the cover panel at a second oblique fold line that extends divergently to the first oblique fold line.

19. The carton according to claim 18, wherein:

the access feature comprises a dispenser panel for being torn at least partially away from the second side panel to at least enlarge an opening in the second side panel; and the dispenser panel is connected to the cover panel for moving outwardly with the cover panel.

20. The carton according to claim 18, wherein:

each of the first and second expandable connections comprises an attachment flap connected to the second side panel;

an edge of the second triangular pleat panel of the first expandable connection is connected to the attachment flap of the of the first expandable connection by a third oblique fold line;

an edge of the second triangular pleat panel of the second expandable connection is connected to the attachment flap of the of the second expandable connection by a fourth oblique fold line.

21. The carton according to claim 20, wherein:

the first and third oblique fold lines extend convergently with respect to one another toward an intersection between the fourth lateral fold line and the longitudinal fold line of the first expandable connection; and the second and fourth oblique fold lines extend convergently with respect to one another toward an intersection between the fourth lateral fold line and the longitudinal fold line of the second expandable connection.

* * * * *